United States Patent [19]

Kennedy, III et al.

[11] 4,356,666

[45] Nov. 2, 1982

[54] FLEXIBLE PARKING SPACE BARRIER

[76] Inventors: Daniel M. Kennedy, III; Patricia C. Kennedy, both of 10105 Burton Glen Dr., Rockville, Md. 20850

[21] Appl. No.: 169,112

[22] Filed: Jul. 10, 1980

[51] Int. Cl.[3] ..... E05B 65/00; E06B 11/00

[52] U.S. Cl. ..... 49/35; 49/49; 49/131

[58] Field of Search ..... 49/35, 49, 131, 132; 70/134

[56] References Cited

U.S. PATENT DOCUMENTS

| | | | |
|---|---|---|---|
| 3,296,741 | 1/1967 | Lubmann | 49/131 |
| 3,299,572 | 1/1967 | Wallace | 49/131 |
| 3,688,439 | 9/1972 | Doxsee | 49/131 |
| 4,050,190 | 9/1977 | Mazzone | 49/35 |
| 4,188,575 | 2/1980 | Palmer et al. | 70/134 X |

FOREIGN PATENT DOCUMENTS

| | | | |
|---|---|---|---|
| 2739878 | 3/1979 | Fed. Rep. of Germany | 49/131 |
| 205848 | 7/1934 | Switzerland | 49/131 |
| 967322 | 8/1964 | United Kingdom | 49/131 |

*Primary Examiner*—Philip C. Kannan

*Attorney, Agent, or Firm*—Stevens, Davis, Miller & Mosher

[57] ABSTRACT

In general, this invention relates to a flexible, hinged post or barrier provided with a curved fixed or spring surface serving as the point of contact between the flexible post and vehicle entering a parking space; a hinged support rod used to anchor a return spring between the post to return the post to a vertical position. The rod also incorporates a bolt slot for a locking mechanism consisting of a single lock with dual functional bolt which can lock the flexible post in an upright position and lock the entire apparatus through its foot onto a base plate by the rod penetrating through holes aligned between the foot and base plate. The base plate is secured to the roadway by spikes, anchor bolts, glues or cements.

25 Claims, 7 Drawing Figures

1
2
9
13
27
28
7
8
15
6
5
3
4
11
10
12

33
14
1
2
15
11
19
18
17
20
12
16

3
5
20
23
16
21
22
24
24
25
18

FLEXIBLE PARKING SPACE BARRIER

This invention relates to an apparatus to control access by vehicles to parking spaces, roadways, parking lots, garages and other areas. In particular, this invention relates to an apparatus which will permit an individual to secure and to hold only for his vehicle's use such parking spaces dedicated or reserved for his exclusive use, without infringing upon general access to the parking lot or other parking spaces.

It is frequently the case that the operator of a motor vehicle resides in an apartment building or works in an office building or similar structure where particular spaces in the contiguous parking lot are allocated to individual tenants or users of the building. Often these spaces are marked as reserved and bear a number or name of the individual or the company for whom they are reserved. It is not unusual for the tenant or user to pay a monthly rental fee to use the specific parking space. Although the spaces may be marked as reserved, the individual for whom they are reserved often arrives at his assigned parking space to find another vehicle occupying that space and is left with no place to park his vehicle. This is a common occurrence, particularly in commercial office buildings, and condominium and apartment buildings with a high volume of transient traffic. Under current practice, operators of such buildings must resort to the employment of security guards to control the usurpation of reserved parking spaces, control access to the entire parking lot by the installation of expensive, remotely controlled gates which limit the entire lot's utilization, or resort to passive signs and techniques threatening the intruder with having his vehicle towed away.

The object of the invention described herein overcomes this difficulty and solves this problem by providing an apparatus for individual control of access to particular parking spaces or roadways in an economical, reliable and convenient manner.

A specific objective of this invention is to provide a flexible post for installation in a parking space to serve as a movable barrier, constructed in a manner such that it will fold underneath a vehicle entering the parking space and return to an upright position when the vehicle backs out, without becoming jammed underneath the vehicle in the undercarriage.

A further objective of this invention is to include in the apparatus a dual function locking mechanism to self-lock the flexible post in an upright position or permit the apparatus to be removed to allow the space to be cleaned, plowed, or used for other purposes.

Other objects and advantages of the invention will become apparent from an examination of the drawings and accompanying description.

In the drawings and accompanying description a preferred embodiment of the present invention is shown and described, but it is to be understood that the drawins and accompanying description are for the purpose of illustration only and do not limit the invention, and that the invention will be confirmed by the appended claims.

Figure 1:
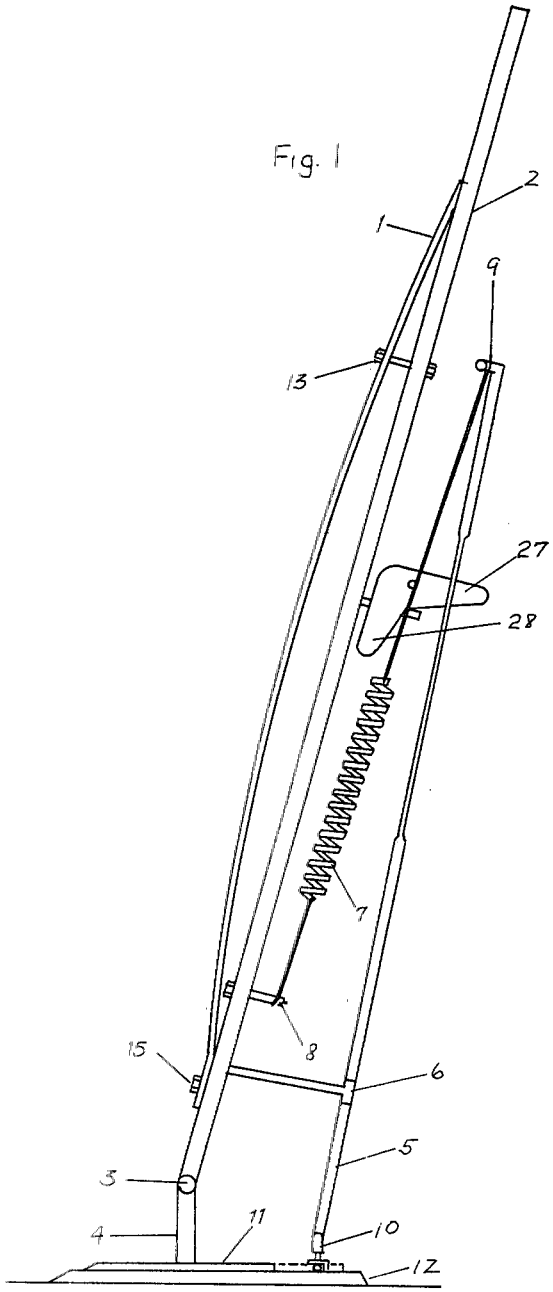
FIG. 1 is a side elevational view of the apparatus embodying the principles of the present invention.

Referring first to FIG. 1, wherein are shown the general features of the invention, the flexible post is divided into a major section 2 and minor section 4 connected to a foot 11. The major and minor section are joined by a hinge 3 which will permit clockwise rotation to a fully depressed position. A leaf or strip spring 1 is attached to the major section of the post at 15 by a bolt and restrained from moving laterally by a bolt 13. The foot 11 rests inside the beveled retaining collar of the base plate 12 which is attached to the ground. A rod 5 is provided, connected to a yoke and hinge assembly 10, which assembly is held in place by the clips 24 attached to the foot 11. The rod 5 passes through a guide collar 6 and shaft which is attached to the major member of the post 2. A spring 7 is attached to the rod at 9 and to the post 2 at 8. Bolt heads 27 and 28 are the major parts of the bolt for a lock mechanism which includes a bolt slot in rod 5.

Figure 2:
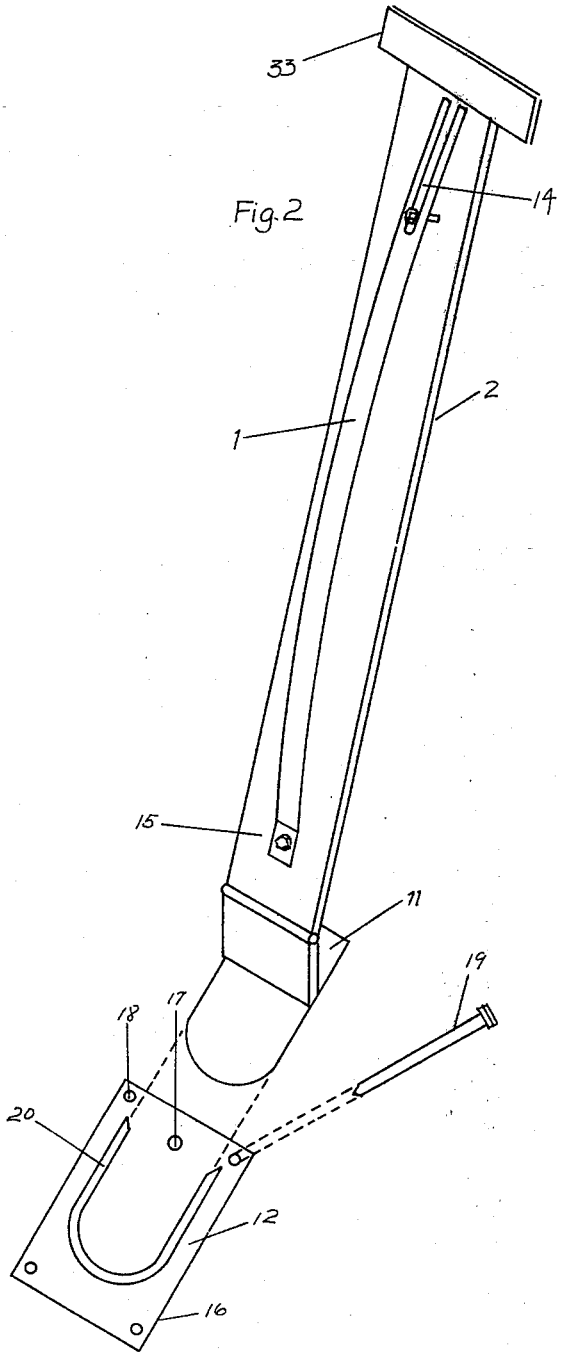
FIG. 2 is a front elevational view of the flexible post over its base plate.
Figure 3:
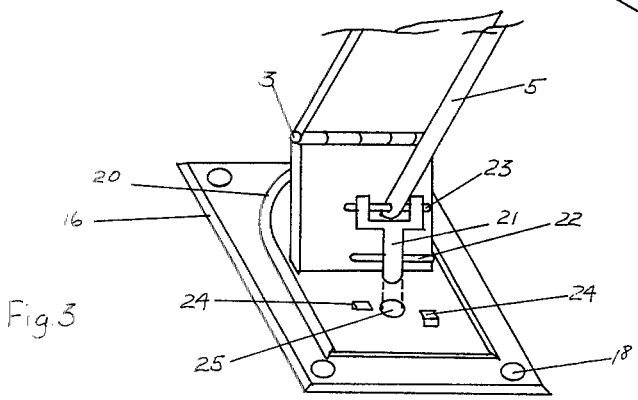
FIG. 3 is a detailed rear elevational view of the post and hinge showing the yoke assembly for the support rod and details of the post foot and base plate.

FIGS. 2 and 3 show further details of the invention. The base plate 12 is constructed with holes 18 which may be used to secure the base to the rod surface with spikes 19 or anchor bolts. Various cements and glues can also be used to secure the base to the road surface. 20 is a beveled collar constructed on the surface of the base plate into which the foot 11 of the flexible post assembly slides. Hole 17 in the base plate aligns with hole 25 in the foot as shown in FIG. 3. The edges of the base plate 16 are beveled. The spring 1 is constructed with a slot 14 and retaining bolt 13 so that the spring may be depressed longitudinally with no lateral motion. A sign 33 is affixed to the top of the assembly.

Details of the yoke 10 and bar 5 assembly shown in FIG. 1 are illustrated in FIG. 3. The bar 5 is attached to the yoke 21 through a swivel pin 23. The bottom tip of the yoke projects through hole 25 in the foot 11 and projects into hole 17 in the base plate. The retaining bar 22 fits underneath clips 24 to hold the entire assembly in place, preventing withdrawl of the foot from the base plate unless the yoke and rod are turned counterclockwise and lifted out of hole 17.

Figure 4:
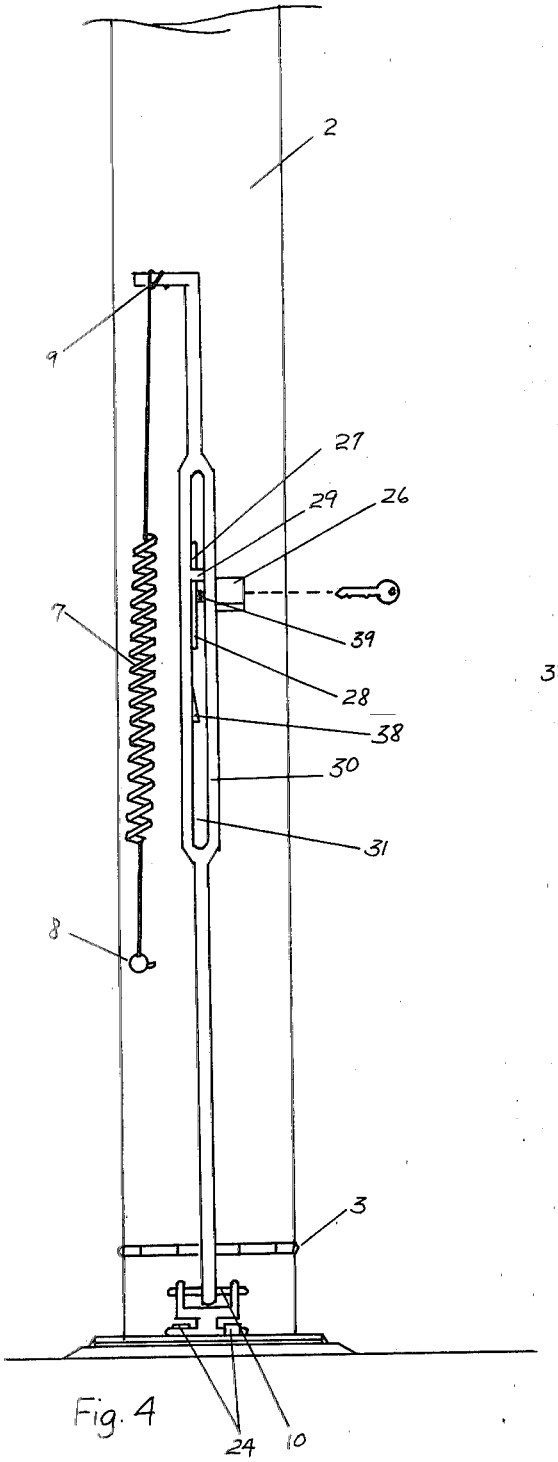
FIG. 4 is a rear elevational view of the flexible post illustrating the spring, support rod, bolt slot and locking mechanism.

FIG. 4 further illustrates the retaining actions of clips 24 acting upon the yoke assembly 10. FIG. 4 also shows the lock 26, double bolt head 27 and 28, lock shaft 39, bolt stop 29, and bolt trip mechanism 38. 30 is the side wall for the bolt slot 31.

Figure 5:
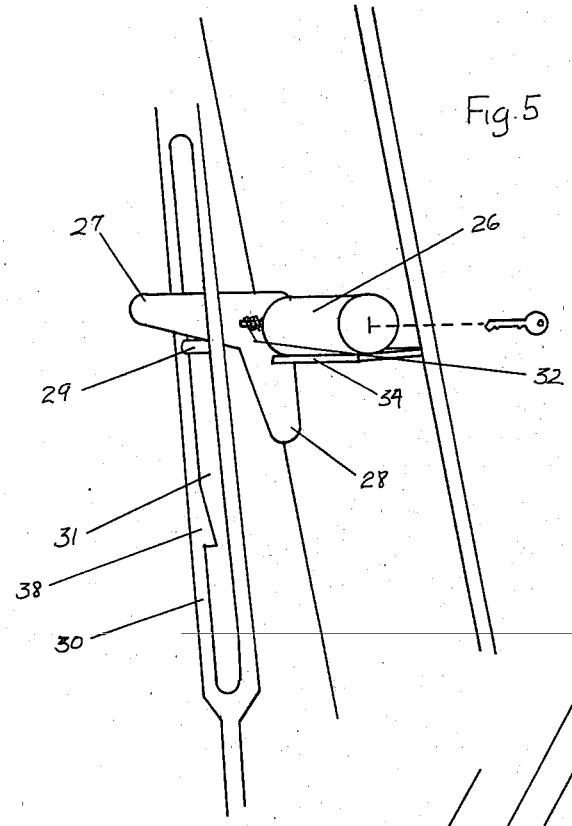
FIG. 5 is a detailed rear view of the flexible post illustrating the bolt slot and locking mechanism.
Figure 6:
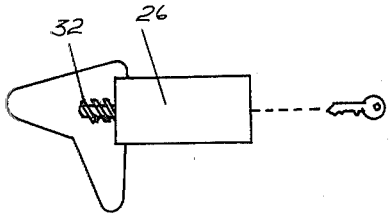
FIG. 6 is a detailed side view of the locking bolt, shaft and spring mechanism.

FIGS. 5 and 6 show the total lock mechanism in greater detail. Lock 26 is installed on the lock platform 34 and includes a spring 32 on the lock shaft 39 providing tension against the bolt heads 27 and 28. The bolt slot 31 between the trip mechanism 38 and the opposite wall is at least as wide as the thickness of bolt head 28.

Figure 7:
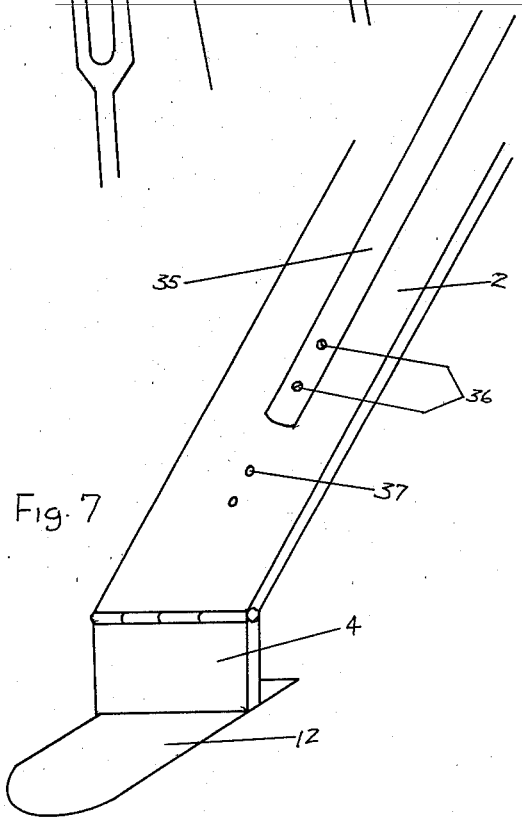
FIG. 7 is a front elevational view of the flexible post showing an alternate mechanism to keep the flexible post depressed below the plane of the undercarriage of the vehicle.

FIG. 7 illustrates an alternative to the spring 1 shown in FIG. 1. 35 is a tube that may be extended above the top of post 2 and attached to the post by bolts at 36. 37 shows alternative positions for attaching tube 35 depending upon desire height.

In practice, a parking space equipped with the apparatus described in this invention is utilized in the following way:

The apparatus can be constructed out of ordinary metal, wood or plastic rod, pipe or flat stock and is approximately three to four feet high and one-half to four inches wide. The top of the apparatus can support a "Reserved" sign or other appropriate legend. The apparatus is installed near the center of the parking space. The owner of the space drives partly in, gets out of the car, unlocks the apparatus, re-enters the car, and drives forward. The bumper begins to depress the apparatus as it pushes against the leaf spring 1. As the apparatus rotates toward full horizontal depression and before the top of the apparatus goes underneath the bumper, the apex of the spring forming the front of the apparatus begins to ride on the undercarriage portion of the automobile forming a point of contact for complete depression of post 2 as the vehicle completes its occupancy of space. When leaving the space the driver enters his car, backs it straight out and drives off. As he pulls out, the apparatus rises without becoming jammed underneath the automobile because the leaf spring keeps the top of the apparatus from becoming engaged underneath the automobile. The spring 7 returns the apparatus to full upright position where it will engage the locking mechanism and relock itself.

The detailed use of specific parts in general operation of the invention will now be readily understood in view of the above description. The upright member 2 includes a flexible joint 3 which may be a simple hinge that connects the upright member to the base or stand that rests upon and is connected to the surface of the parking lot. The flexible joint or hinge may also be included in the upright such that it typically divides the upright into a major and minor section, the minor section being attached to the foot 11 and preferably extended above the foot two or three inches. The flexible joint 3 of the upright member is installed in such a way that the upright member 2 will fall along the length of the parking space when pushed from the front, which would be that part facing toward the vehicle entering the parking space. The apparatus of this invention includes a spring mechanism 7 that will return the upright member to an upright position when any force depressing said member is removed. The preferred spring operating mechanism 7 is one which applies a turning force above the flexible joint 3, thus working in compatability with available leverage forces. This is accomplished by attaching the major upright member to a rod, shaft or other rigid structure such as a metal rod, through a spring 7, one end of which spring is attached high up on the rod, preferably near its top, and the lower end of the spring is attached to the major portion 2 of the upright. The rod 5 passes through a guide collar 6 and shaft attached to 2. The lower end of the rod 5 is attached to the base in such a manner that it can rotate in the same direction as the upright member 2. The bottom of the rod 5 or point of rotation for the rod at 23 may be either adjacent to the minor member 4 of the upright or attached away from the upright such that the rod 5 becomes the hypotenuse of a right triangle formed with the upright and the base 12. The degree to which the spring 7 can be extended to force the return of 2 to an upright position will vary depending upon how far the base of the rod 5 is removed from a position adjacent to the upright 4 and the difference in height between 3 and 23. When a force such as an entering vehicle pushes the upright member 2 back, extending spring 7, the upright member 2 returns to a position generally perpendicular to the base when the force is removed.

In the apparatus described in this invention, the front of the upright member 2, which is that part that faces toward the entering vehicle above the hinge joint 3, is curved in the form of an arc, the extremities of which are preferably at the highest and lowest points of the upright member 2. When the upright member 2 is deflected into a position parallel to the surface of the roadway, the apex of the arc is preferably approximately six inches above the roadway. In this way the apex of the arc rather than the upper extremity of the major upright portion 2 will be the point of physical contact with the undercarriage of a vehicle. As a result, when a vehicle which has pulled into a parking space, deflects and drives over the upright member 2, backs up, the upright member cannot become engaged in the various crevices and holes that are typically found in the under portion of a vehicle and damages the device and the vehicle. In the preferred embodiment described in FIG. 1 and following figures, the arc is formed by employing a leaf spring attached to the upright member 2. The flexibility of spring 1 can accommodate the conformation of the undercarriage of vehicles, which varies significantly from vehicle to vehicle and from place to place in the undercarriage of a given vehicle. By providing a spring action to the arc, the depth of the arc will vary following the conformation of the underside of the vehicle; thus, maintaining contact with the undercarriage with minimum force and risk of damage to the vehicle.

In the preferred embodiment of this invention a single lock 26 is included with bolt heads 27 & 28 and bolt slot mechanism 31 that controls both the function of locking the upright member 2 in a vertical position plus unlocking the entire assembly so that the apparatus may be removed completely from the base 12 for cleaning or plowing of the parking space or to allow unreserved use of the space. In addition, the locking system includes a trip mechanism 38 that returns the bolt to a locked position as the upper member 2 rises from a horizontal to a vertical position. The apparatus is locked with respect to either deflecting 2 into its horizontal position or removal of the apparatus from its base when bolt head 27 is resting on the stop 29. In that position, the rod 5 cannot rise with respect to post 2 and, therefore, cannot deflect. To depress 2, stop 29 must rise with respect to the position of the lock 26 when the post 2 is in a full upright position. This is due to the difference in the axis of revolution between hinge 3 and rod 5 at the swivel joint 23. Further, since bolt head 27 projects through rod 5 at the bolt aperture 31, rod 5 cannot be turned through 90° to free 22 from the restraining clips 24 and so the tip of the yoke cannot be lifted out of the hole 17 in the base plate 12 and hole 25 in the foot 11 to permit the foot to be slid out of the base plate.

In FIG. 5 when bolt head 27 is turned clockwise 90° due to operation of the key and lock, post 2 can be deflected. However, because of the eccentricity in mounting the double headed bolt 27–28 onto the lock shaft 39, bolt head 28 becomes engaged in the bolt aperture 31 below stop 29 preventing the rod 5 from being rotated for removal of the apparatus but allowing depression of post 2 as desired. As 2 is deflected, bolt head 28 travels down the bolt aperature 31 and over the trip mechanism 38. When post 2 begins to rise to a vertical position, bolt 28 rises and engages the trip mechanism 38 which causes rotation of the lock shaft counterclockwise and the return of bolt head 27 to the locked position resting upon stop 29. To permit rotation of the rod to remove the apparatus from the base, bolt head 27 is rotated at 90° clockwise with the key and lock, post 2 is partly deflected manually, and the bolt is rotated with key and lock another 90° to free bolt head 28 from the aperature. Rod 5 is then rotated 90°, lifted out of holes 17 and 25, and the apparatus removed in its entirety from the base plate by sliding post 11 backwards. The base plate, preferably not thicker than one-quarter of an inch steel with beveled edges, offers no resistance to snowplow blades or other uses.

An alternative modification of this invention illustrated in FIG. 7 shows a tube replacing spring 1 illustrated in FIG. 1. This tube can be installed upon the front of post 2 by the user at a point selected by the user to assure that the front of the automobile when fully parked in a parking space will not extend over the tip of the apparatus. This variation can be used when there is no curbing that could interfere with the traverse of the tube with post 2 to a horizontal position or when no other automobiles can park in the space immediately in front of the users.

Obviously, small changes may be made in the form of construction of the invention without departing from the spirit thereof. It is desired to include all such as properly come within the scope claimed and not confine the invention to the exact form shown and described here.

What is claimed as new and desired to secure by Letters Patent is:

1. A parking space barrier comprising:

an upright post hinged to a mounting foot in a manner permitting said post to rotate, upon the application of force thereto, in a first direction from a first upright rest position generally perpendicular to a roadway surface to a second position, generally parallel to a roadway surface, a curved vehicle underside protective member attached to and disposed along a front side of said upright post, said protective member being curved such that only said protective member contacts with the underside of a vehicle when a vehicle contacts with and rotates said post from said first to said second position, means coupled to said post for biassing said post toward said first position, a base plate receiving and releasably retaining said foot, said base plate including means for securing said base plate to a roadway surface, a rod extending along said upright post which is coupled to said base plate through a hinge and to said post in a manner permitting said rod to rotate about its hinge upon rotative movement of said post about its hinge, and, a locking mechanism coupled to said post and rod comprising a first locking means which, when in a locking position, prevents rotation of said post and rod about their respective hinges to thereby lock said post in said generally perpendicular orientation.

2. A parking space barrier as in claim 1 wherein said first locking means comprises a bolt portion coupled to said rod which, when in a locking position, engages with a stop member provided on said rod, said bolt portion when engaging with said stop member preventing said rod and vertical post from rotating about their respective hinges.

3. A parking space barrier as in claim 1 wherein said locking mechanism further comprises means operable upon return of said upright post to a generally perpendicular position relative to said roadway surface for moving said first locking means to said locking position.

4. A parking space barrier as in claim 1 wherein said biassing means is a spring.

5. A parking space barrier as in claim 1 wherein said protective member is a leaf or strip spring restrained from lateral movement relative to said post but affixed to allow lengthwise extension and return.

6. A parking space barrier as in claim 1 wherein said biassing means is a coil spring attached to a lower portion of said post and to an upper portion of said rod, the hinge for said rod being at or below the height of the hinge of said post.

7. A parking space barrier as in claim 1 wherein said protective member is a rod or tube which is adjustable in height to a point significantly above the top of said post.

8. A parking space barrier as in claim 1 further comprising means for supporting a sign.

9. A parking space barrier as in claim 8 wherein said base plate has an open-ended beveled retaining collar affixed to its surface for slidably receiving said mounting foot.

10. A parking space barrier as in claim 9 wherein said foot and said base plate having respective holes therein which align when said foot is properly received in said base plate, said rod being hinged to a locking post which engages with said holes to prevent removal of said foot from said base plate, said rod being axially movable to disengage said locking post from said holes to allow removal of said foot from said base plate.

11. A parking space barrier as in claim 10 further comprising means for coupling said locking post to said base plate in a manner preventing withdrawal of said locking post by said rod.

12. A parking space barrier as in claim 11 wherein said coupling means includes means for preventing withdrawal of said locking post unless said rod is first rotated about its axis by a predetermined amount.

13. A parking space barrier as in claim 12 wherein said coupling means comprises a retaining bar provided on said locking post and a pair of holding clips provided on said base plate for engaging with said retaining bar to prevent withdrawal of said locking post from said holes, said retaining bar being rotatable to disengage from said holding clips upon rotation of said rod about its axis by said predetermined amount.

14. A parking space barrier as in claims 12 or 13 wherein said locking mechanism includes a second locking means which, when in a locking position, prevents rotation of said rod about its axis by said predetermined amount to thereby prevent withdrawal of said locking post from said holes.

15. A parking space barrier as in claim 14 wherein said first locking means comprises a bolt portion coupled to said rod which, when in a locking position, engages with a stop member provided on said rod, said bolt portion when engaging with said stop member preventing said rod and vertical post from rotating about their respective hinges.

16. A parking space barrier as in claim 15 wherein said rod includes a slot and said bolt portion is selectively insertable in said slot to form with said slot said second locking means, said bolt portion, when in said slot, preventing rotation of said rod about its axis by said predetermined amount, and the withdrawal of said locking post from said holes.

17. A parking space barrier comprising:

an upright barrier member hinged to a mounting foot in a manner permitting said barrier member to rotate in a first direction from a first upright rest position generally perpendicular to a roadway surface to a second position, generally parallel to a roadway surface, said barrier member including a curved vehicle underside protective area on a side of said barrier member which is opposite to said first direction of rotation, said protective area being shaped and mounted such that only said protective area contacts with the underside of a vehicle when a vehicle contacts with and rotates said barrier member from said first to said second position, means coupled to said barrier member for biassing said barrier member in a second direction toward said first position and for providing resistance to rotation of said barrier member from said first to said second position, means for coupling with and supporting said mounting foot to a roadway surface, said means for supporting said mounting foot comprising a mounting member for mounting on a roadway surface, said mounting member including means for receiving and releasably supporting said mounting foot, and, a locking mechanism comprising a first locking means coupled to said barrier member for selectively locking said barrier member against rotative movement and a second locking means for selectively locking said foot to said mounting member.

18. A parking space barrier comprising:

an upright barrier member hinged to a mounting foot in a manner permitting said barrier member to rotate in a first direction from a first upright rest position generally perpendicular to a roadway surface to a second position, generally parallel to a roadway surface, means coupled to said barrier member for biassing said barrier member in a second direction toward said first position and for providing resistance to rotation of said barrier member from said first to said second position, means for coupling with and supporting said mounting foot to a roadway surface, said means for supporting said mounting foot comprising a mounting member for mounting on a roadway surface, said mounting member including means for receiving and releasably supporting said mounting foot, a locking mechanism comprising a first locking means coupled to said barrier member for selectively locking said barrier member against rotative movement and a second locking means for selectively locking said foot to said mounting member.

19. A parking space barrier comprising:

an upright barrier member hinged to a mounting foot in a manner permitting said barrier member to rotate in a first direction from a first upright rest position generally perpendicular to a roadway surface to a second position, generally parallel to a roadway surface, means coupled to said barrier member for biassing said barrier member in a second direction toward said first position and for providing resistance to rotation of said barrier member from said first to said second position, means for coupling with and supporting said mounting foot to a roadway surface, said means for supporting said mounting foot comprising a mounting member for mounting on a roadway surface, said mounting member including means for receiving and releasably supporting said mounting foot, a locking mechanism comprising a locking means for selectively locking said foot to said mounting member.

20. A parking space barrier as in claims 17, 18 or 19 wherein said barrier member comprises an arched leaf spring.

21. A parking space barrier as in claim 17 wherein said barrier member comprises an upright post hinged to said mounting foot and a curved vehicle underside protective member mounted to a side of said post opposite to said first direction of rotation, said curved protective member being shaped and mounted to said post such that only said protective member contacts with an underside of a vehicle when a vehicle contacts with and rotates said post from said first to said second position.

22. A parking space barrier as in claims 18, 19 or 21 wherein said mounting member has an open-ended beveled retaining collar affixed to its surface for slidably receiving said mounting foot.

23. A parking space barrier as in claims 17 or 18 wherein said first locking means further comprises means operable upon return of said barrier member to a generally perpendicular position relative to said roadway surface for moving said first locking means to said locking position.

24. A parking space barrier as in claim 21 wherein said first locking means further comprises means operable upon return of said upright post to a generally perpendicular position relative to said roadway surface for moving said first locking means to said locking position.

25. A parking space barrier as in claims 17, 18 or 19 wherein said biassing means is a spring.

* * * * *